US009246255B1

(12) United States Patent
Holthus et al.

(10) Patent No.: US 9,246,255 B1
(45) Date of Patent: Jan. 26, 2016

(54) QUICK SLIDE CONNECTOR ASSEMBLY

(71) Applicant: Yazaki North America, Inc., Canton, MI (US)

(72) Inventors: John Holthus, South Lyon, MI (US); William Gronowicz, Jr., Westland, MI (US); Zoran Ljubevski, Canton, MI (US)

(73) Assignee: YAZAKI NORTH AMERICA, INC., Canton, MI (US)

( * ) Notice: Subject to any disclaimer, the term of this patent is extended or adjusted under 35 U.S.C. 154(b) by 0 days.

(21) Appl. No.: 14/482,442

(22) Filed: Sep. 10, 2014

(51) Int. Cl.
*H01R 13/514* (2006.01)
*H01R 13/436* (2006.01)

(52) U.S. Cl.
CPC ..... *H01R 13/4364* (2013.01); *H01R 13/4361* (2013.01)

(58) Field of Classification Search
CPC ..... H01R 13/4362; H01R 13/4361; H01R 13/4223; H01R 13/4368; H01R 13/4365
USPC ..... 439/752, 157, 160, 310, 595, 701, 744, 439/354, 357, 364, 248, 638
See application file for complete search history.

(56) References Cited

U.S. PATENT DOCUMENTS

| | | | | |
|---|---|---|---|---|
| 4,565,416 | A | 1/1986 | Rudy et al. | |
| 4,586,771 | A | 5/1986 | Kraemer et al. | |
| 5,217,386 | A | 6/1993 | Ohsumi et al. | |
| 5,674,088 | A | 10/1997 | Roche et al. | |
| 6,077,117 | A | 6/2000 | Iwahori | |
| 6,494,732 | B2 * | 12/2002 | Kashiyama | H01R 13/641 439/160 |
| 6,648,658 | B2 | 11/2003 | Okabe et al. | |
| 6,994,597 | B2 * | 2/2006 | Majima | H01R 13/4367 439/489 |
| 8,231,409 | B2 * | 7/2012 | Lebrun | H01R 13/4365 439/595 |
| 8,376,778 | B2 * | 2/2013 | Obata | H01R 13/4223 439/595 |

* cited by examiner

*Primary Examiner* — Edwin A. Leon
(74) *Attorney, Agent, or Firm* — Remarck Law Group PLC

(57) ABSTRACT

A connector assembly can include a housing, a terminal retainer, and a terminal position assurance member. The terminal retainer can be removably coupled with the housing and define a primary retaining lock for an electrical contact assembly. The terminal retainer can cooperate with the housing to form a compartment that can receive the electrical contact assembly. The compartment can extend along a mating axis of the housing, with a first frontal opening and a rear opening spaced from one another along the mating axis. A portion of the first frontal opening can be elastically deformable such that a size of the first frontal opening is variable. The terminal position assurance member can be removably coupled with the housing to define a secondary retaining lock for the electrical contact assembly. The terminal position assurance member can be positioned to inhibit elastic deformation of the portion of the first frontal opening.

20 Claims, 12 Drawing Sheets

QUICK SLIDE CONNECTOR ASSEMBLY

FIELD

The present disclosure relates to connectors and, more particularly, to electrical connectors.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

The materials used in making the various components of a vehicle can often be recycled. The process of recycling a vehicle is extremely complicated, as different sub-components and assemblies must be removed and disassembled. The efficiency of recycling efforts is dependent on the extent that components of distinct materials are separated from one another. For example, electrical components generate scrap metal and plastic, including wire, cable, conduit, cable trays, and connectors. If various wiring can be separated by wire type, such as between high-voltage power cable and low-voltage communications wire, the scrap of each type can be separately weighed and graded based on copper or aluminum content. Recovery rates vary for each wire type, so keeping wire types separate ensures the highest return for each wire type. However, electrical components are often difficult to disassemble. A wire harness, for example, may house numerous connections. Wires that cannot be separated from the housing of the connector in an acceptable period of time in view of the value of the material to be collected are often cut from the housing. The housing itself thus includes lost portions of wire and the electrical contacts.

SUMMARY

In various embodiments of the present disclosure, a connector assembly for retaining an electrical contact assembly is disclosed. The connector assembly can include a housing, at least one terminal retainer, and at least one terminal position assurance member. The housing can extend along a mating axis. The at least one terminal retainer can be removably coupled to the housing. The at least one terminal retainer can define a primary retaining lock for an electrical contact assembly positioned within the housing. The at least one terminal retainer can cooperate with the housing to form at least one compartment formed within the housing. The at least one compartment can receive at least a portion of the electrical contact assembly. The at least one compartment can extend along the mating axis. The at least one compartment can have a first frontal opening and a rear opening spaced from one another along the mating axis. The first frontal opening can be positioned in a mating direction along the mating axis from the rear opening and the rear opening can be positioned in a disengaging direction along the mating axis from the first frontal opening. At least a portion of the first frontal opening can be elastically deformable such that a size of the first frontal opening is variable. The at least one terminal position assurance member can be removably coupled to the housing and be operable to define a secondary retaining lock for the electrical contact assembly. When the at least one terminal position assurance member is coupled to the housing, the at least one terminal position assurance member is positioned at a supporting position at which the at least one terminal position assurance member inhibits elastic deformation of the portion of the first frontal opening.

In various embodiments of the present disclosure, a connector assembly for retaining at least one electrical contact assembly is disclosed. The connector assembly can include a housing, a terminal retainer, and a terminal position assurance member. The housing can extend along a mating axis. The terminal retainer can be removably coupled to the housing. The terminal retainer can define a primary retaining lock for an electrical contact assembly positioned within the housing. The terminal retainer can cooperate with the housing to form at least one compartment formed within the housing. The at least one compartment can receive at least a portion of the at least one electrical contact assembly. The at least one compartment can extend along the mating axis. The at least one compartment can have a first frontal opening and a rear opening spaced from one another along the mating axis. The first frontal opening can be positioned in a mating direction along the mating axis from the rear opening and the rear opening can be positioned in a disengaging direction along the mating axis from the first frontal opening. At least a portion of the first frontal opening can be elastically deformable such that a size of the first frontal opening is variable. The terminal position assurance member can be removably coupled to the housing and be operable to define a secondary retaining lock for the at least one electrical contact assembly. The terminal retainer further includes at least one plate extending orthogonally relative to the mating axis between a leading edge and a trailing edge. The terminal retainer further includes at least one slot formed in the at least one plate between the leading edge and the trailing edge. The terminal retainer further includes at least one cantilevered arm projecting into the at least one slot in the mating direction from the at least one plate.

In various embodiments of the present disclosure, a connector assembly for retaining at least one electrical contact assembly is disclosed. The connector assembly can include a housing, a terminal retainer, and a terminal position assurance member. The housing can extend along a mating axis. The terminal retainer can be removably coupled to the housing. The terminal retainer can define a primary retaining lock for the at least one electrical contact assembly positioned within the housing. The terminal retainer can cooperate with the housing to form at least one compartment formed within the housing. The at least one compartment can receive at least a portion of the at least one electrical contact assembly. The at least one compartment can extend along the mating axis. The at least one compartment can have a first frontal opening and a rear opening spaced from one another along the mating axis. The first frontal opening can be positioned in a mating direction along the mating axis from the rear opening and the rear opening can be positioned in a disengaging direction along the mating axis from the first frontal opening. At least a portion of the first frontal opening can be elastically deformable such that a size of the first frontal opening is variable. The terminal position assurance member can be removably coupled to the housing and be operable to define a secondary retaining lock for the at least one electrical contact assembly. The terminal retainer is moveable into the housing in a direction transverse to the mating axis and the terminal position assurance member is moveable into the housing along the mating axis.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
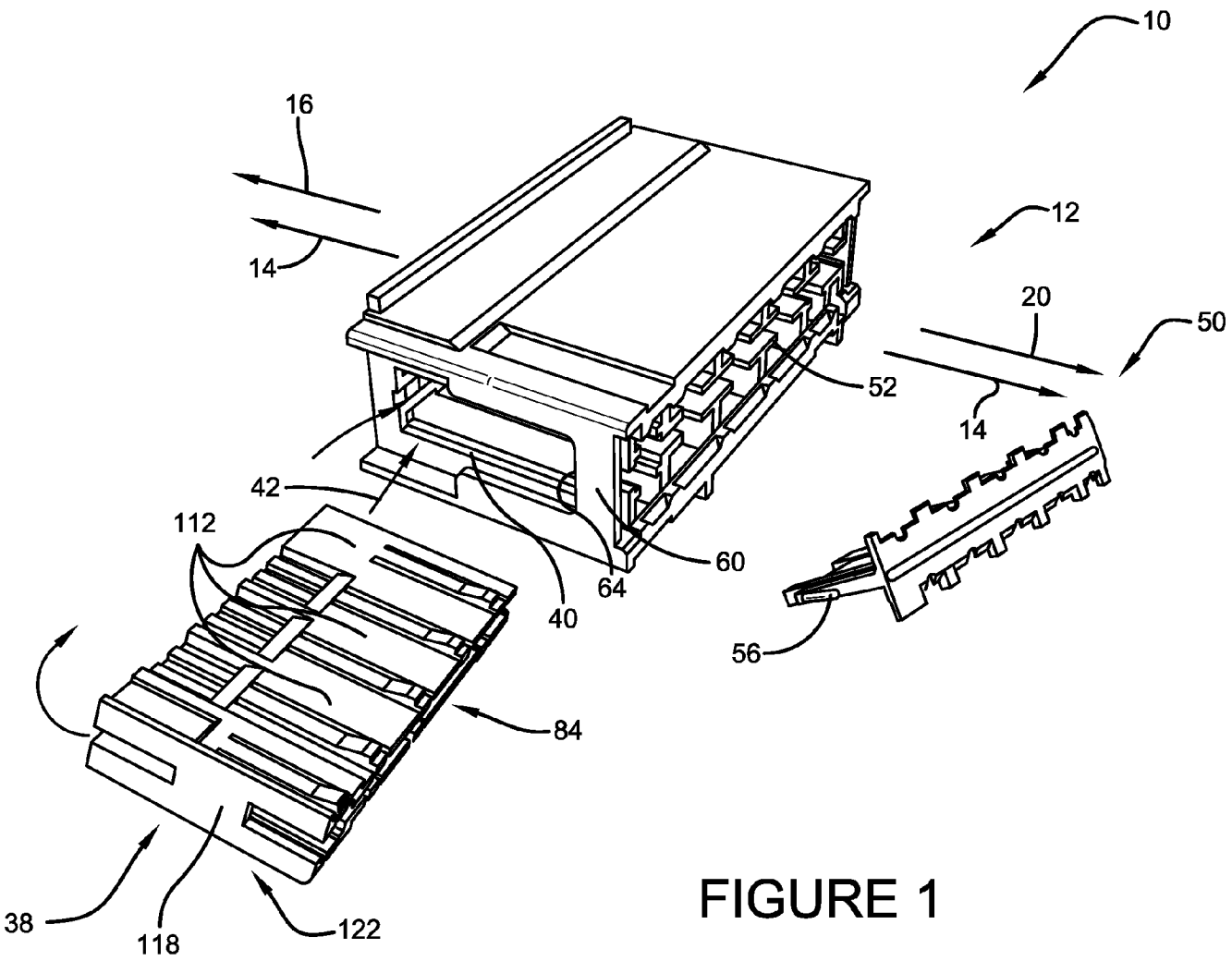
FIG. 1 is a first exploded view of an example connector assembly according to some implementations of the present disclosure.

As previously discussed, the materials used in making the various components of a vehicle can often be recycled after the vehicle has reached the end of its useful life. It can be desirable to fully break-down the different sub-components and assemblies of the vehicle to separate distinct materials. Electrical components such as wire harnesses can be difficult to fully dissemble efficiently, wherein recycling efficiency can be a function of the time required for disassembly and the value of recovered material. Wires that cannot be easily separated from a connector housing may be cut as close to the housing as possible, thereby leaving some wire and the electrical contacts within the plastic housing.

Accordingly, a connector assembly and method are presented for enhanced recyclability. The exemplary connector assembly disclosed herein can be quickly and fully disassembled. However, the exemplary connector assembly is also robust and can rigidly retain one or more electrical connections throughout its useful life.

The present disclosure provides a three-piece connector assembly as an illustrated embodiment. The exemplary connector assembly can include a housing, a terminal retainer, and a terminal position assurance member. One or more openings can be defined by the connector assembly, such as within the housing and/or on the outside of the housing. Each of the one or more openings can receive an electrical contact assembly, e.g., including an electrical contact and a wire. The electrical contact can be fixed to an end of the wire. The openings can define planes through which the electrical contact assembly passes during insertion. A portion of the structure forming the openings that receives an electrical contact assembly can be elastically deformable. Insertion of the electrical contact assembly can cause the opening to deform and enlarge to allow passage of the electrical contact assembly. After the electrical contact assembly passes through the opening, the opening can recover to its original size. The structure permitting elastic deformation can also define a primary retaining lock that inhibits the electrical contact assembly from being removed from the opening.

The terminal retainer can be received in the housing and define the primary retaining lock selectively inhibiting removal of the electrical contact assembly. The terminal retainer can cooperate with the housing to define one or more of the openings. The terminal position assurance member can be received in the housing after insertion of the terminal retainer to form a three-piece connector assembly. The terminal position assurance member can be positioned to buttress an opening that has been cooperatively defined by the terminal retainer and the housing, inhibiting subsequent deformation. After the terminal position assurance member is received in the housing, the electrical contact assembly is inhibited from being withdrawn from the housing since deformation of the opening that has been cooperatively defined by the terminal retainer and the housing is inhibited.

The terminal retainer can be releasibly engaged with the housing, such as through a snap-fit arrangement. The terminal position assurance member can be received in the housing and define a secondary retaining lock selectively inhibiting removal of the electrical contact assembly. The terminal position assurance member can also be releasibly engaged with the housing, such as through a snap-fit arrangement. The terminal position assurance member can be removable, leaving the opening unsupported and again elastically deformable. When the terminal position assurance member has been removed, the electrical contact assembly can remain locked with respect to the housing by the terminal retainer. When the terminal position assurance member has been removed and the terminal retainer is shifted laterally, the electrical contact assembly can be removed from the housing. The exemplary connector assembly thus enhances recyclability by allowing components of different materials to be easily separated from one another.

Referring now to FIGS. 1-5, a connector assembly 10 can include a housing 12 formed as a unitary structure from plastic. Alternatively, the housing 12 could be formed from a plurality of structures engaged together. The plastic chosen to form the housing 12 can be resilient in environments of high temperature and/or chemical exposure. The housing 12 extends along a mating axis 14. The mating axis 14 can be the axis along which the connector assembly 10 moves to mate with one or more other connectors or connector assemblies. In the illustrated embodiment, a mating direction is along the mating axis 14 and is referenced at 20. The mating direction 20 can be the direction in which the connector assembly 10 moves relative to one or more other connectors or connector assemblies when interconnecting. An end 18 referenced in FIG. 5 can be a rear of the connector assembly 10. An end 22 referenced in FIG. 5 can be a front of the connector assembly 10. The front end 22 of the connector assembly 10 can abut another connector when the connector assembly 10 is mated with another connector. In the illustrated embodiment, a disengaging direction is along the mating axis 14 and is referenced at 16. The disengaging direction 16 is opposite to the mating direction 20 and can be the direction the connector assembly 10 moves relative to one or more other connectors or connector assemblies when being disengaged from the one or more other connectors or connector assemblies.

The terminal retainer 38 can define a second piece of the connector assembly 10. The terminal retainer 38 can be a unitary structure formed from plastic. In some embodiments of the present disclosure, a terminal retainer could be formed from a plurality of structures engaged with one another. Further, some embodiments of the present disclosure could include more than one terminal retainer engaged with a common housing. The plastic chosen to form the terminal retainer 38 can be resilient in environments of high temperature and/or chemical exposure. The terminal retainer 38 can be received in an opening 40 in the housing 12, referenced in FIGS. 1 and 4. In an embodiment having two terminal retainers, the terminal retainers could be received from opposite sides of the housing or adjacent sides of the housing. The terminal retainer 38 can be movable, such as by sliding, into the housing 12 in an insertion direction 42 to an operating position. The insertion direction 42 can be transverse to the mating axis 14, such as perpendicular or some other angle. The housing 12 includes a first positive stop 44 limiting movement of the terminal retainer 38 in the insertion direction 42. The terminal retainer 38 is shown in the operating position in FIG. 5.

Figure 12:
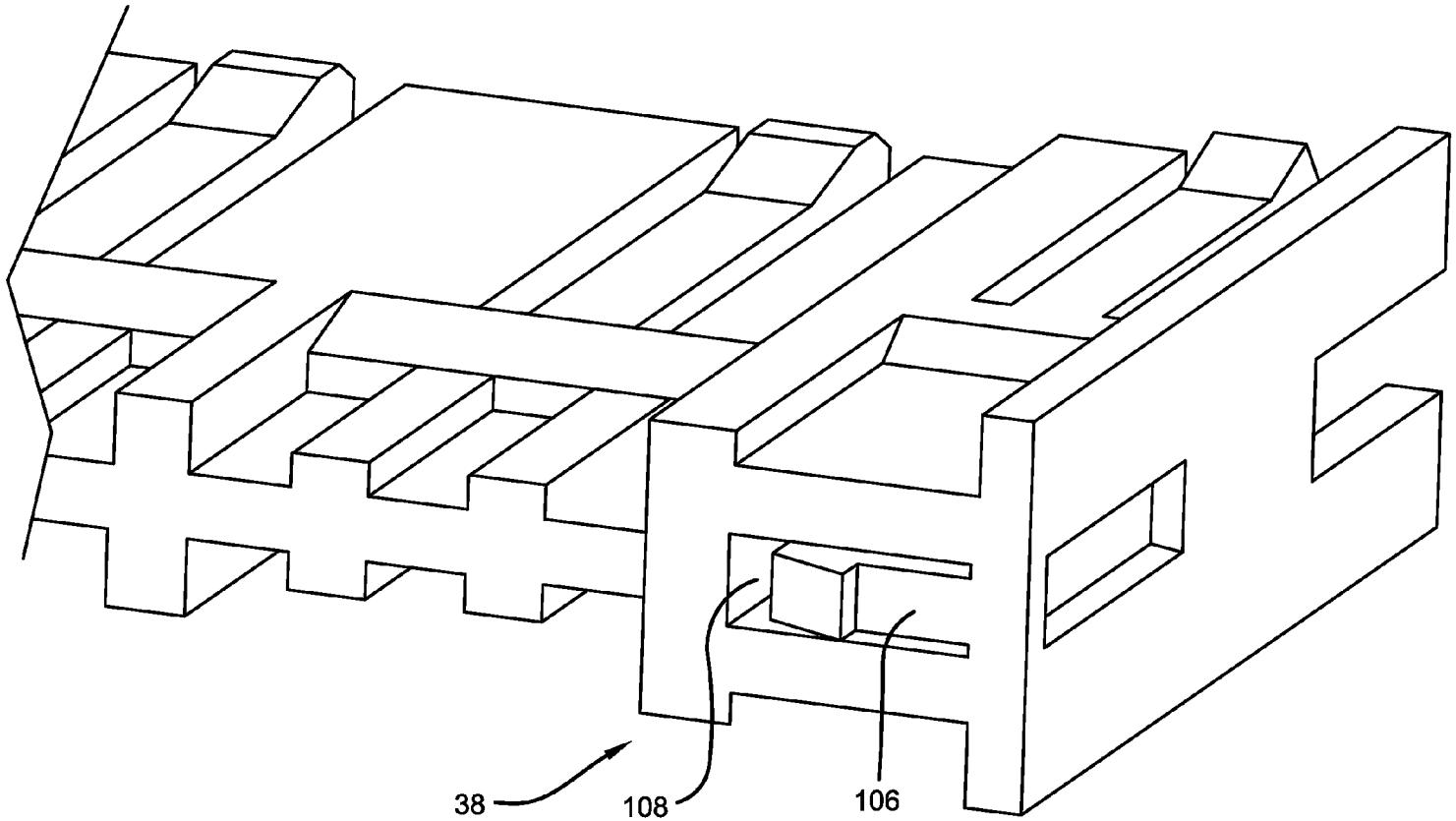
FIG. 12 is a perspective view of the terminal retainer shown in FIGS. 1-4.
Figure 13:
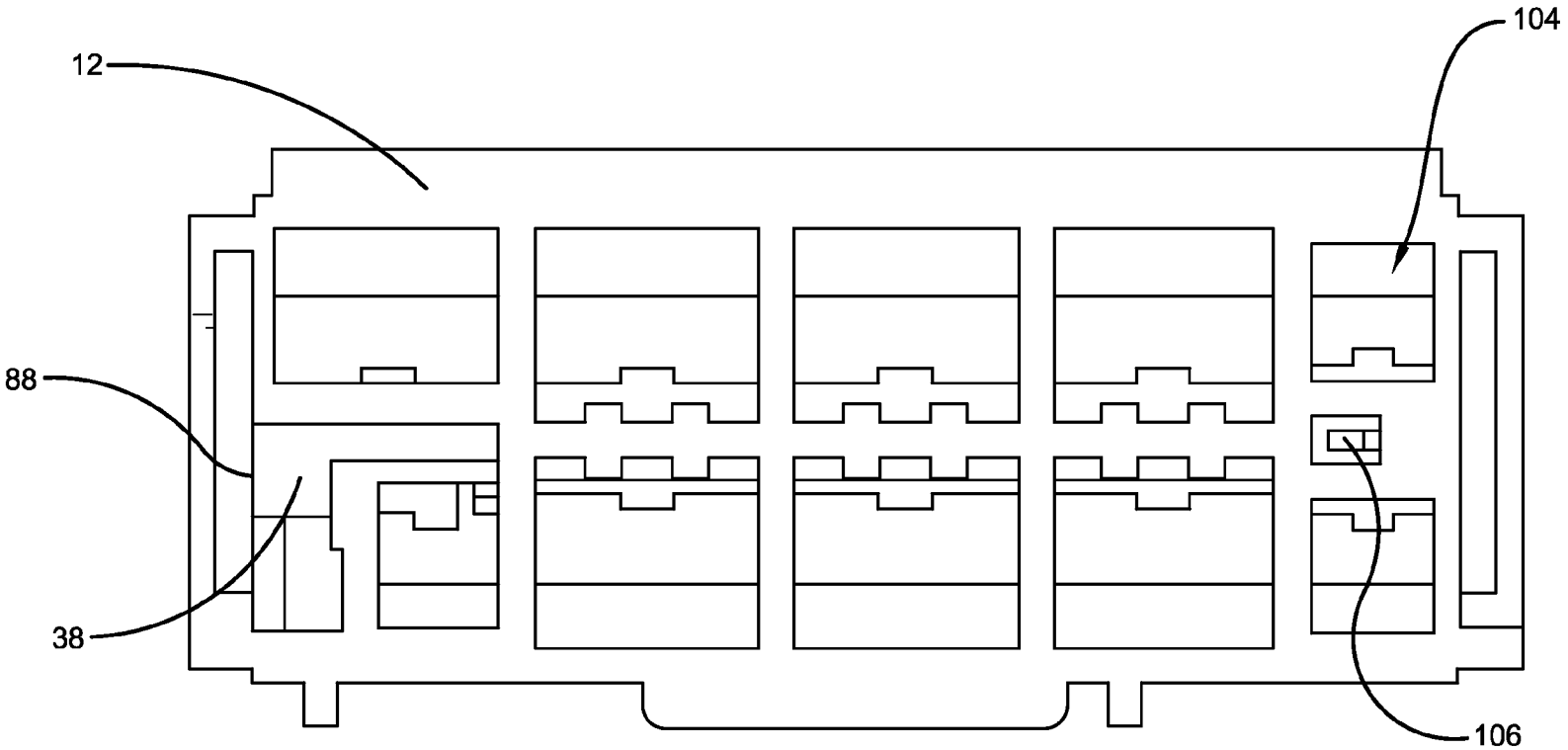
FIG. 13 is a rear view of the connector assembly shown in FIGS. 1-5.
Figure 14:
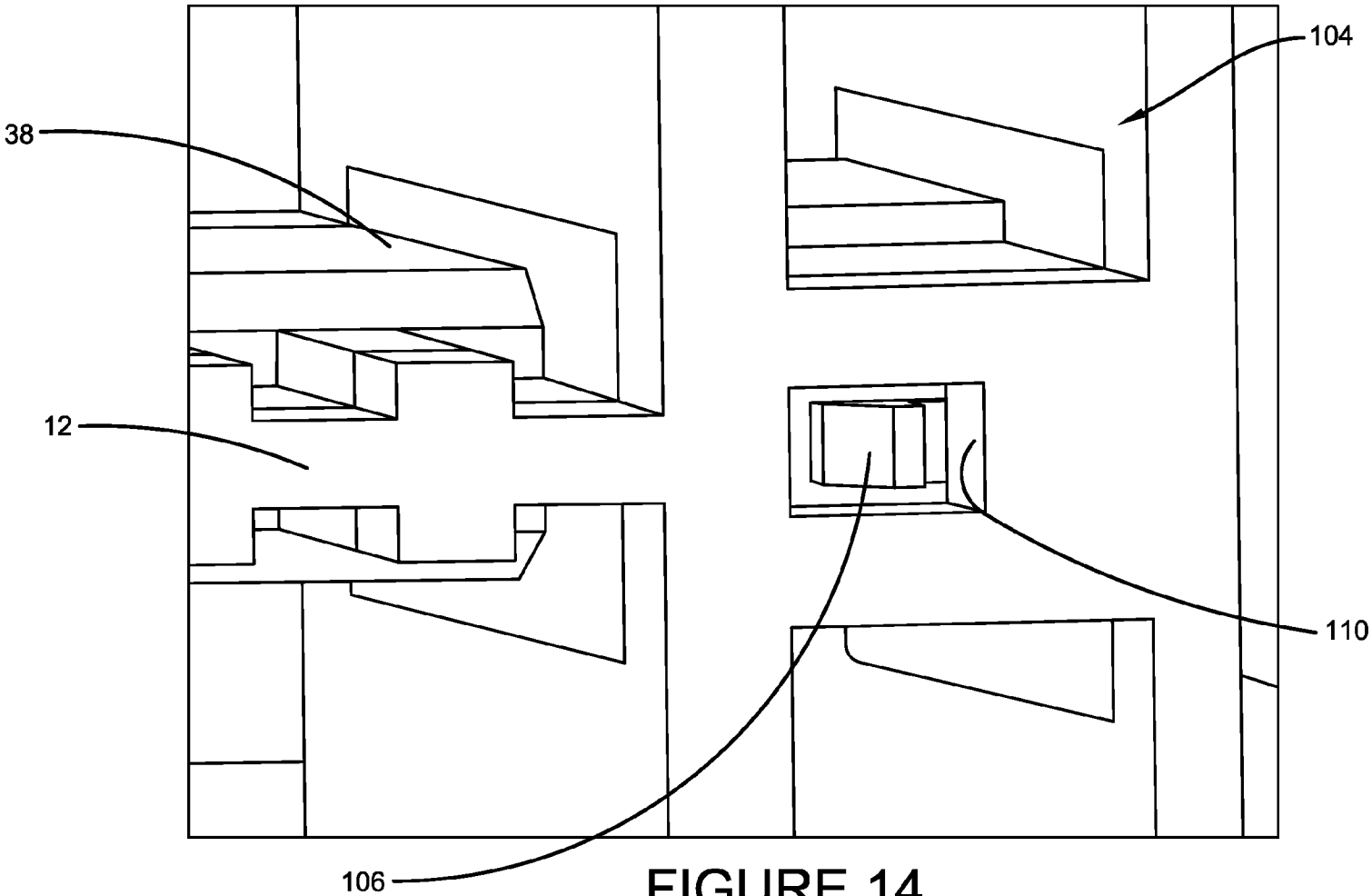
FIG. 14 is a magnified perspective view of the connector assembly shown in FIGS. 1-5 illustrating a portion of the structure shown in FIG. 13.

The terminal retainer 38 can be freely slidable into the housing 12, to the operating position. The terminal retainer 38 can engage the housing 12 in a snap-fit connection 104, referenced in FIGS. 13 and 14. As shown in FIG. 12, the terminal retainer 38 can include a locking arm 106. The locking arm 106 can be deflected into a pocket 108 defined by the terminal retainer 38 when the terminal retainer 38 is moved into the housing 12. When the terminal retainer 38 reaches the operating position, the locking arm 106 can recover and project into an aperture 110 defined by the housing 12 to define the snap-fit connection 104. The snap-fit connection 104 can be accessible from an exterior of the housing 12. In order to disengage the terminal retainer 38 from the housing 12, the locking arm 106 can be deflected back into the pocket 108 and the terminal retainer 38 can be moved from the operating position in a direction opposite to the insertion direction 42.

Figure 6:
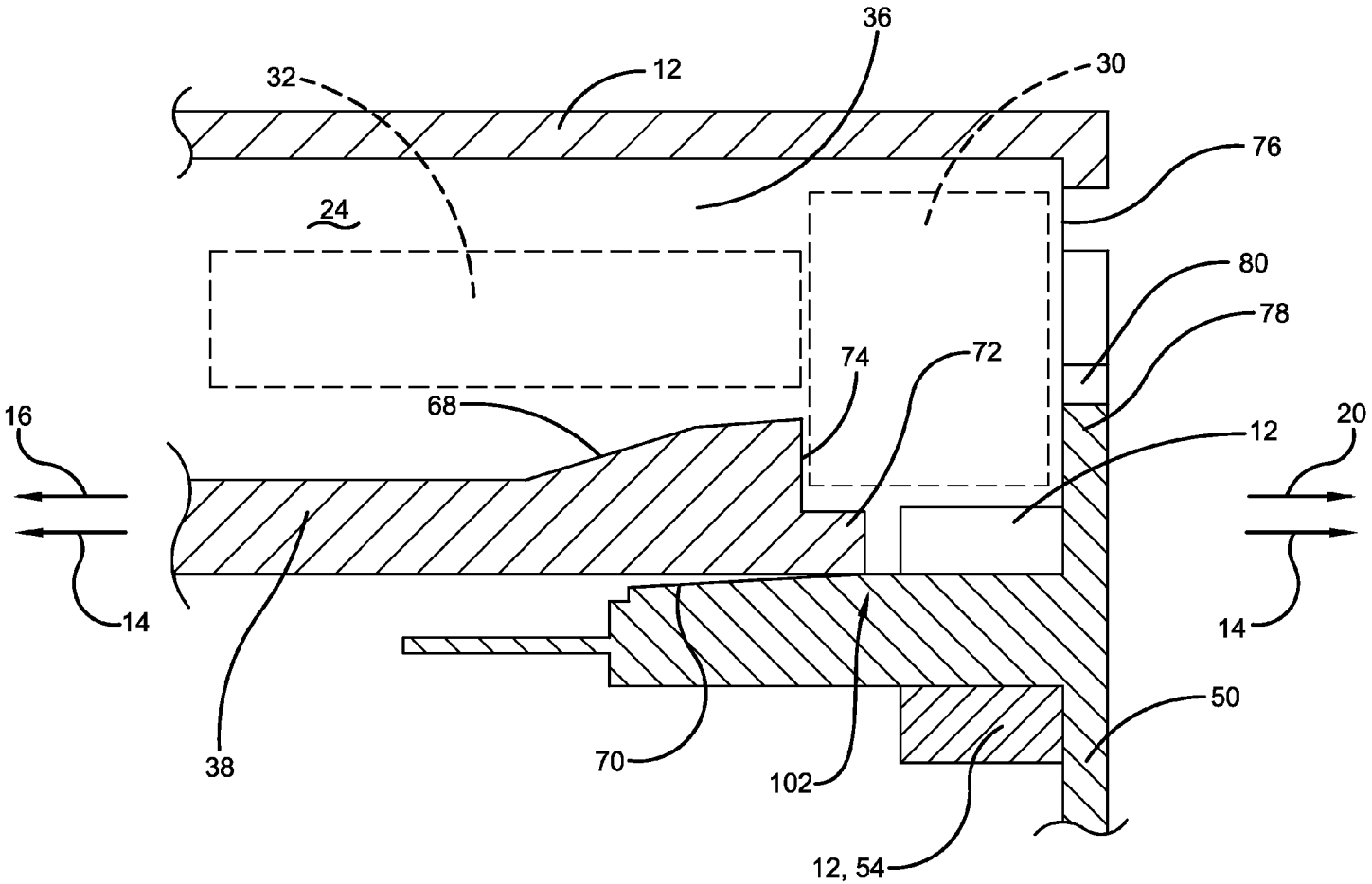
FIG. 6 is a partial cross-sectional view taken through section lines 6-6 in FIG. 5.
Figure 7:
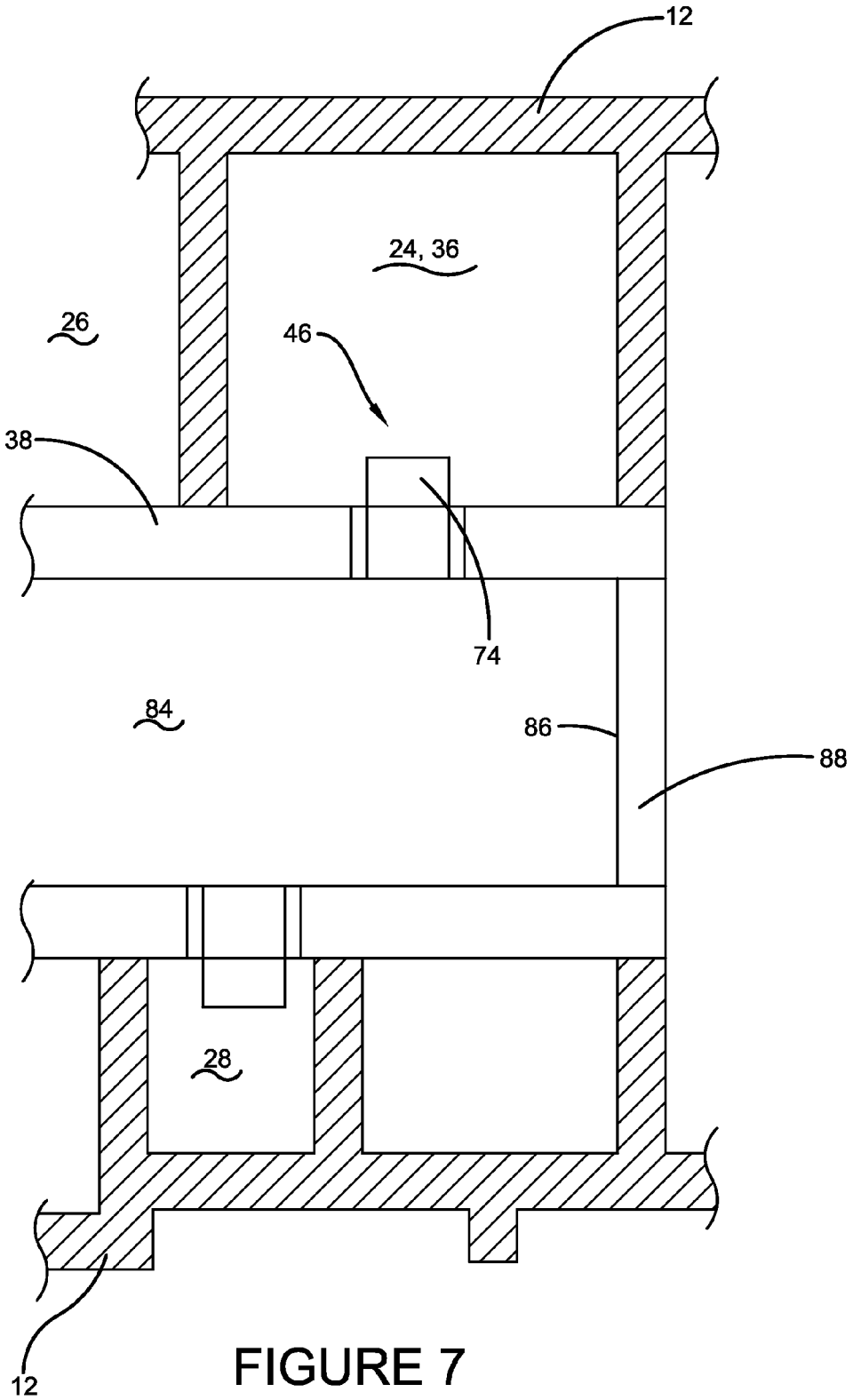
FIG. 7 is a partial cross-sectional view taken through section lines 7-7 in FIGS. 5 and 8.
Figure 8:
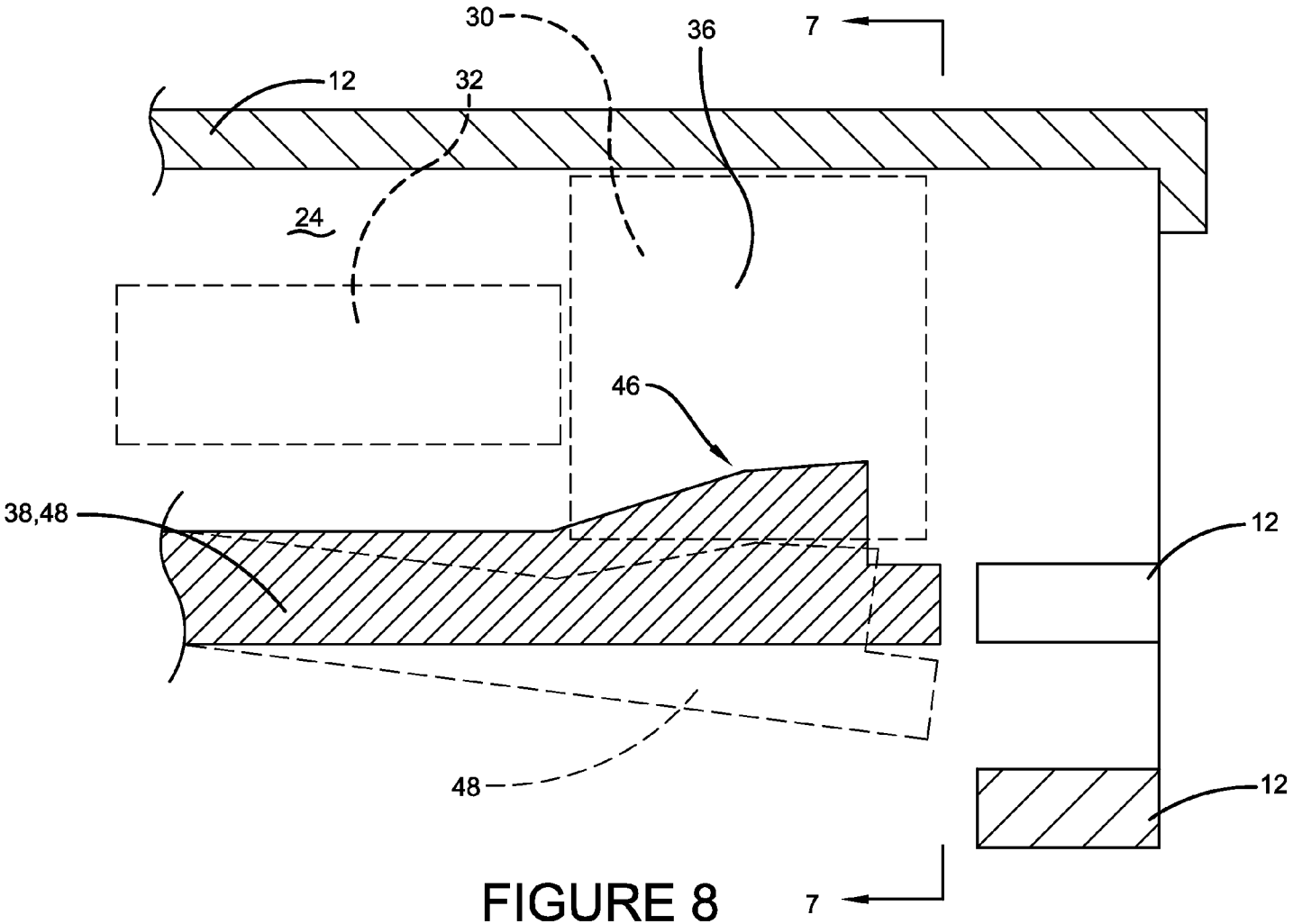
FIG. 8 is a cross-sectional view taken in the same plane as FIG. 6, but showing the connector assembly without a terminal position assurance member and showing in phantom the elastic deformation of a terminal retainer.

Referring now to FIGS. 6-8, at least one compartment 24 can be defined within the housing 12. In the illustrated embodiment, a plurality of compartments is defined in the housing 12, such as compartments 24, 26, 28 shown in FIG. 7. Some embodiments of the present disclosure can include a plurality of compartments arranged in two orthogonal directions relative to the mating axis 14, such as a plurality of rows and/or a plurality of columns of compartments. The description associated with the compartment 24 can be applicable to all of the compartments of the exemplary connector assembly 10. The compartments 24, 26, 28 can be sized differently or the same.

The compartment 24 can extend along the mating axis 14. As shown schematically, in FIG. 8, an electrical contact 30 can be inserted in the compartment 24. The electrical contact 30 can be fixed to a wire 32 to define an electrical contact assembly. The compartment 24 can have a rear opening 34, referenced in FIGS. 3 and 4. The compartment 24 can have a first frontal opening 36, referenced in FIGS. 6-8. The first frontal opening 36 can be defined in part by the housing 12 and in part by the terminal retainer 38. A plane of the first frontal opening 36 is shown in FIG. 7. The openings 34, 36 can be spaced from one another along the mating axis 14. The rear opening 34 can be positioned in the disengaging direction 16 along the mating axis 14 from the first frontal opening 36. The first frontal opening 36 can be positioned in the mating direction 20 along the mating axis 14 from the rear opening 34.

In the exemplary embodiment, the terminal retainer 38 and the housing 12 can cooperate to form the first frontal opening 36. The terminal retainer 38 can define a portion 46, referenced in FIGS. 7 and 8, of the first frontal opening 36 that is elastically deformable such that a size of the first frontal opening 36 is variable. The terminal retainer 38 can include a cantilevered arm 48 defining the portion 46 of the first frontal opening 36. The arm 48 includes a first ramp 68 elevating in the mating direction 20. The first ramp 68 can terminate in a first wall 74 extending substantially perpendicular to the mating axis 14. As shown in phantom in FIG. 8, the arm 48 can deflect away from the compartment 24 during insertion of the electrical contact 30. The electrical contact 30 can be moved in the mating direction 20 during insertion in the compartment 24 and past the first frontal opening 36. When a rear edge of the electrical contact 30 moves past the end of the ramp 68, the arm 48 can recover, bringing the first wall 74 into a confronting or abutting relationship with the electrical contact 30. If the electrical contact 30 is urged in the disengaging direction 16, the first wall 74 can act to inhibit the electrical contact 30 from being removed from the first frontal opening 36. Thus, the terminal retainer 38, through the arm 48 and the first wall 74, can define a primary retaining lock inhibiting removal of the electrical contact 30.

The terminal position assurance member 50 can define a third piece of the connector assembly 10. The terminal position assurance member 50 can be a unitary structure formed from plastic. Some embodiments of the present disclosure can include more than one terminal position assurance member. The plastic chosen to form the terminal position assurance member 50 can be resilient in environments of high temperature and/or chemical exposure. The terminal position assurance member 50 can be received in an opening 52 in the housing 12, referenced in FIGS. 1 and 2. The terminal position assurance member 50 can be movable, such as by sliding, into the housing 12 in the disengaging direction 16 to a supporting position. The housing 12 includes a second positive stop 54, referenced in FIG. 6, limiting movement of the terminal position assurance member 50 in the disengaging direction 16. The terminal position assurance member 50 is shown in the supporting position in FIGS. 5 and 6.

Figure 9:
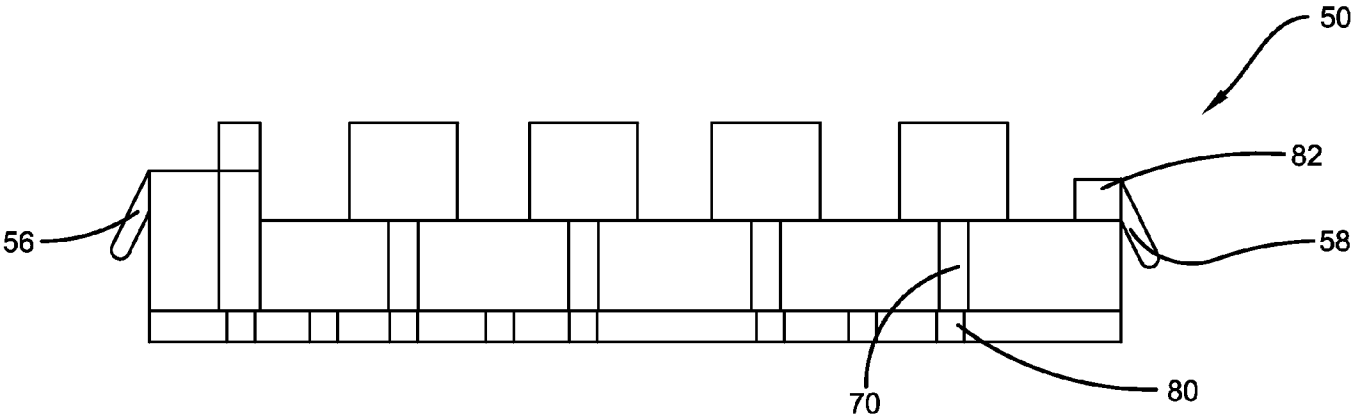
FIG. 9 is a top view of the terminal position assurance member shown in FIGS. 3-6.
Figure 10:
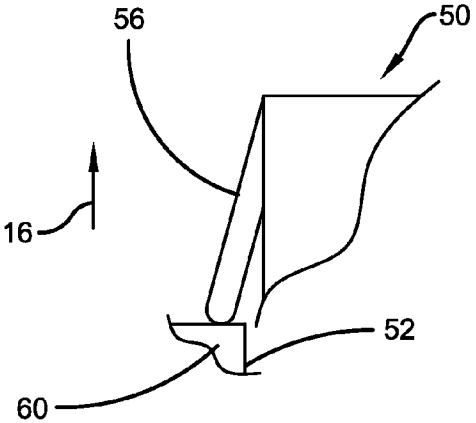
FIG. 10 is a magnified view of a portion of the terminal position assurance member shown in FIGS. 3-6 and 9.

The terminal position assurance member 50 can be coupled with the housing 12 in a snap-fit connection when in the supporting position. The terminal position assurance member 50 can include first and second arms 56, 58, referenced in FIG. 9. The arms 56, 58 can be elastically deformed during insertion of the terminal position assurance member 50 in the housing 12. The arms 56, 58 can bend upon engagement with posts 60, 62 defined by the housing during insertion of the terminal position assurance member 50 in the housing 12. The first arm 56 can be deflected by the post 60 during insertion of the terminal position assurance member 50 in the housing 12. The second arm 58 can be deflected by the post 62 during insertion of the terminal position assurance member 50 in the housing 12. As insertion continues and is completed, the arms 56, 58 can move past the posts 60, 62 and recover. The first arm 56 can recover and be received in an aperture 64 in the housing 12. This condition of the first arm 56 is shown in FIG. 10. The second arm 58 can recover and be received in an aperture 66 in the housing 12.

Figure 11:
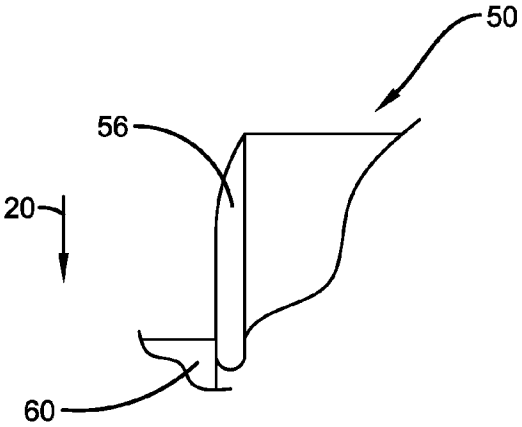
FIG. 11 is a magnified view of the portion of the terminal position assurance member shown in FIG. 10, wherein the terminal position assurance member is being removed from the housing.

The snap-fit connection inhibits movement of the terminal position assurance member 50 from the supporting position in the mating direction 20 relative to the housing 12. The snap-fit connection is accessible from an exterior of the housing 12. The arms 56, 58 can be pressed inward, out of the apertures 64, 66, to release the snap-fit connection. This pressed-inward condition of the first arm 56 is shown in FIG. 11. When the snap-fit connection is released, the terminal position assurance member 50 is slidable relative to the housing 12 and can be removed from the housing 12 in the mating direction 20.

As best shown in FIG. 6, the terminal position assurance member 50 can abut the portion 46 of the first frontal opening 36 such that the terminal position assurance member 50 inhibits elastic deformation of the portion 46 of the first frontal opening 36. After the electrical contact 30 and wire 32 have been inserted into the compartment 24 past the ramp 68 in the mating direction 20, the terminal position assurance member 50 can be inserted into the housing 12. A second ramp 70 of the terminal position assurance member 50 can buttress the distal end 72 of the arm 48, as referenced at 102. This second ramp 70 elevates in the mating direction 20 and underlies the first ramp 68.

Figure 5:
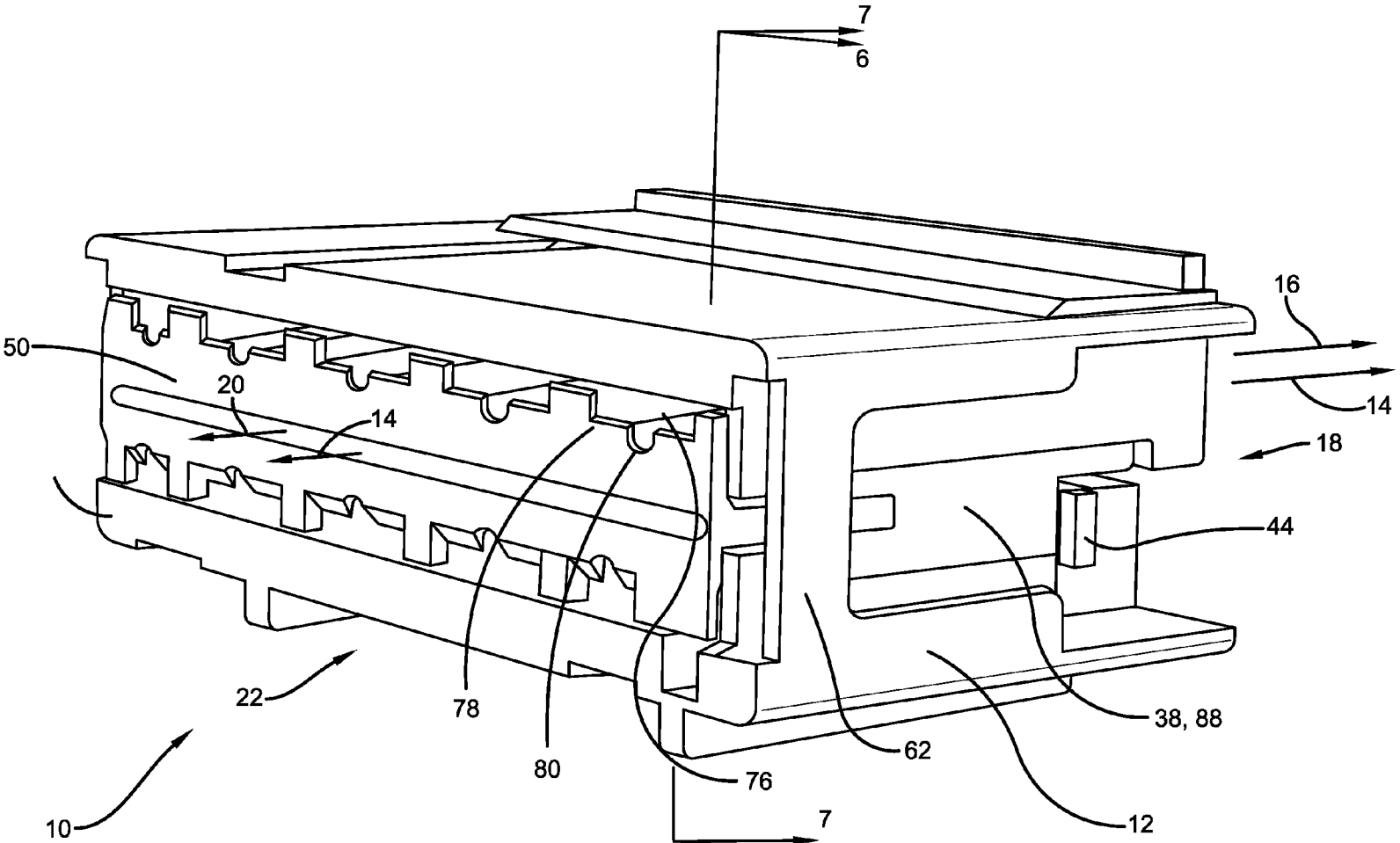
FIG. 5 is an isometric view of the connector assembly shown in FIGS. 1-4 in an assembled condition.

As best shown in FIGS. 5 and 6, the connector assembly 10 can also include a second frontal opening 76 adjacent to and spaced from the first frontal opening 36 along the mating axis 14 in the mating direction 16. An electrical contact from a mating electrical connector can be received in the second frontal opening 76 to engage the electrical contact 30 positioned between the first frontal opening 36 and the second frontal opening 76 to form an electrical connection with the electrical contact 30. In the exemplary embodiment, the housing 12 and the terminal position assurance member 50 cooperate to define a perimeter of the second frontal opening 76. The second frontal opening 76 can be smaller than the first frontal opening 36. A second wall 78 of the terminal position assurance member 50 can extend substantially perpendicular to the mating axis 14 and can define a portion of the perimeter of the second frontal opening 76. The first wall 74 and the second wall 78 can be spaced from one another along the mating axis 14. The electrical contact 30 can be located between the first wall 74 and the second wall 78. The second wall 78 can inhibit the electrical contact 30 from moving out of the housing 12. The second wall 78 can include a notch 80 to accommodate a male projection of a mating electrical connector. It is noted that the electrical contact 30 could be a male contact and the notch 80 could therefore accommodate a male projection of the electrical contact 30. It is further noted that embodiments of the present disclosure could be practiced without a notch such as notch 80.

The terminal position assurance member 50 can supplement the snap-fit connection 104 by being engaged with the terminal retainer 38 to inhibit the terminal retainer 38 from fully moving out of the operating position, in a direction opposite of the insertion direction 42. For example, the terminal position assurance member 50 can include a positive stop 82, referenced in FIGS. 3 and 10, received in a pocket 84 defined by the terminal retainer 38. The stop 82 is encircled by the terminal retainer 38. The stop 82 abuts an inside surface 86 of a wall 88 of the terminal retainer 38 (FIG. 7) when the terminal position assurance member 50 is in the supporting position and when the terminal retainer 38 is in the operating position.

Figure 2:
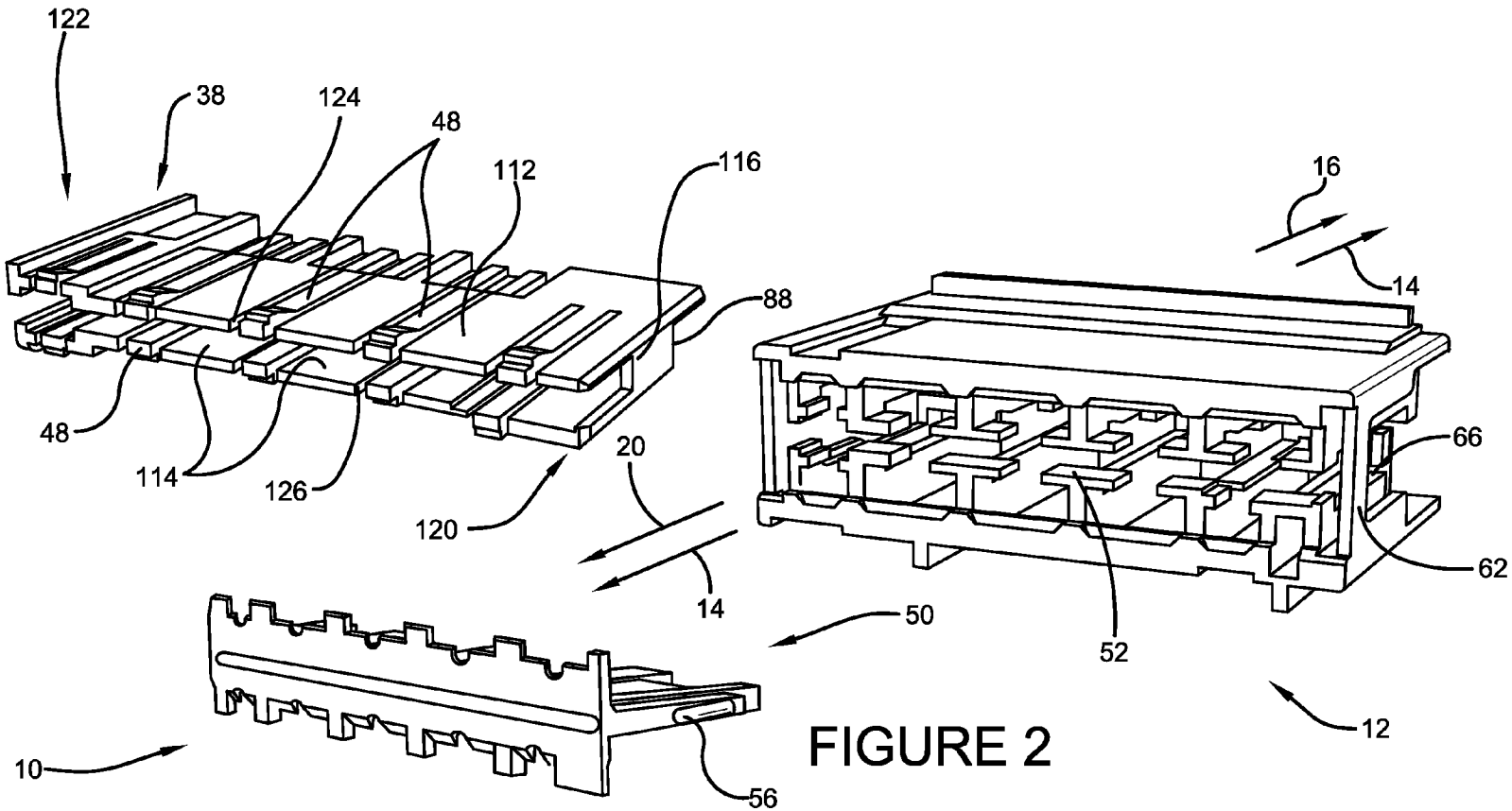
FIG. 2 is a second exploded view of the connector assembly shown in FIG. 1.
Figure 3:
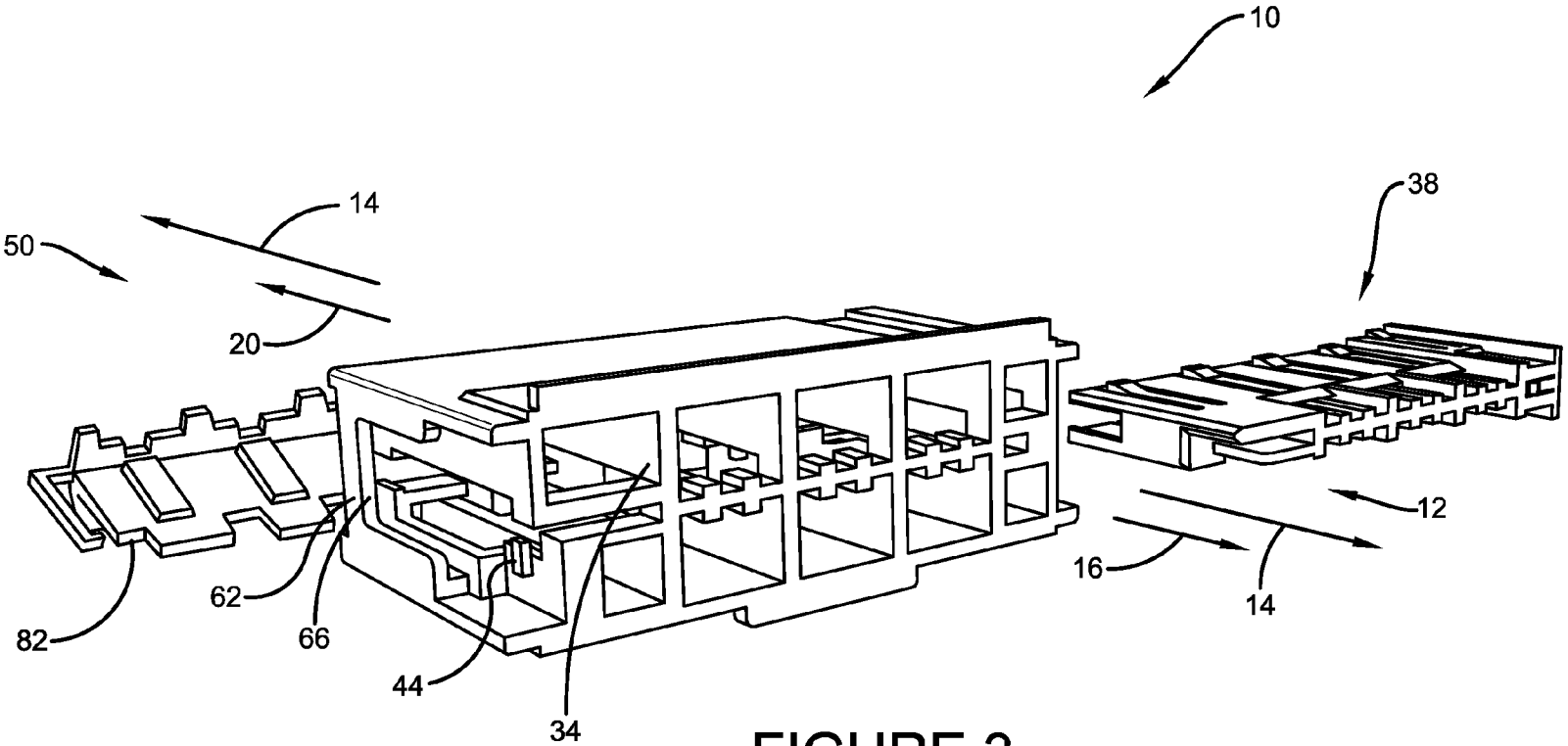
FIG. 3 is a third exploded view of the connector assembly shown in FIGS. 1 and 2.
Figure 4:
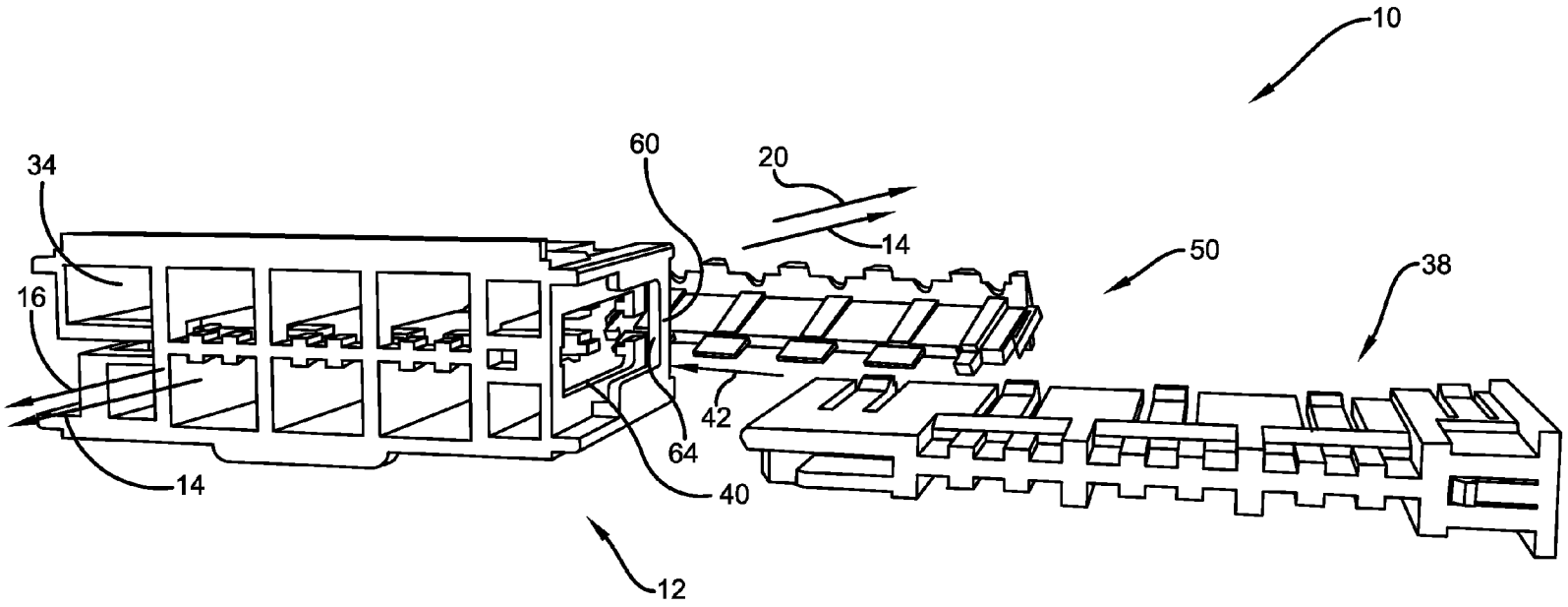
FIG. 4 is a fourth exploded view of the connector assembly shown in FIGS. 1-3.

Referring to FIG. 2, the terminal retainer 38 can include a first plate 112 and a second plate 114. The first plate 112 and a second plate 114 can be interconnected and spaced from one another by a first side wall 116 and a second side wall 118 (referenced in FIG. 1). The pocket 84 (referenced in FIG. 1) can be defined by the first plate 112, the second plate 114, the first side wall 116, and the second side wall 118. Each of the plates 112, 114 can extend orthogonally relative to the mating axis 14 between a leading edge 120 and a trailing edge 122. The leading edge 120 is insertable into the housing 12 and is tapered to enhance the ease of insertion of the terminal retainer 38 into the housing 12. A first plurality of slots, such as the slot referenced at 124, can be formed in the first plate 112. A second plurality of slots, such as the slot referenced at 126, can be formed in the second plate 114. The slots 124, 126 can be positioned between the leading edge 120 and the trailing edge 122. Arms 48 can individually project into each of the slots 124, 126, in the mating direction 20 from the plate 112, 114. The arms 48 projecting from the first plate 112 can be in mirrored relation to the arms 48 projecting from the second plate 114, as shown in FIG. 2.

When it is desired to remove the electrical contact 30 from the housing 12, the terminal position assurance member 50 can be released from engagement with the housing 12. The terminal position assurance member 50 can be released by pressing in and deflecting the arms 56, 58 and by then moving the terminal position assurance member 50 in the mating direction 20 relative to the housing 12. Removal of the terminal position assurance member 50 from the housing 12 can disengage the secondary retaining lock holding the electrical contact 30 in place. After the terminal position assurance member 50 is removed from the housing 12, the electrical contact 30 can be retained from being removed from the housing 12 by the terminal retainer 38, such as by the arm 48, which acts as the primary retaining lock. The electrical contact 30 can abut the first wall 74 of the arm 48 and thus be inhibited from moving in the disengaging direction 16.

The first wall 74 can extend less than fully across a width of the compartment 24, as best shown in FIG. 7. In various embodiments of the present disclosure, the first wall 74 can extend less than halfway across the width of the compartment, less than one-quarter across the width, or less than some other, smaller fraction of the width.

In the illustrated embodiment, the first wall 74 can be shifted laterally from the operating position to disengage the primary retaining lock. For example, the locking arm 106 can be deflected back into the pocket 108 and the terminal retainer 38 can be removed from the housing 12 by moving from the operating position in a direction opposite of the insertion direction 42.

Instead of completely removing the terminal retainer 38 from the housing 12, the primary retaining lock can be disengaged by laterally shifting the terminal retainer 38 into a disengaged position. The disengaged position can correspond to movement of the terminal retainer 38 such that the first wall 74 is out of contact with the electrical contact 30. The electrical contact 30 can then be removed from the compartment 24 without fully removing the terminal retainer 38 from the housing.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known procedures, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The term "and/or" includes any and all combinations of one or more of the associated listed items. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A connector assembly for retaining at least one electrical contact assembly, comprising:

a housing extending along a mating axis;

at least one terminal retainer being removably coupled with the housing and operable to define a primary retaining lock for the electrical contact assembly, wherein the at least one terminal retainer cooperates with the housing to form at least one compartment formed within the housing for receiving at least a portion of the at least one electrical contact assembly, the at least one compartment extending along the mating axis and having a first frontal opening and a rear opening spaced from the first frontal opening along the mating axis, the first frontal opening positioned in a mating direction along the mating axis from the rear opening and the rear opening positioned in a disengaging direction along the mating axis from the first frontal opening, wherein at least a portion of the first frontal opening is elastically deformable such that a size of the first frontal opening is variable; and at least one terminal position assurance member being removably coupled to the housing and operable to define a secondary retaining lock for the electrical contact assembly, wherein, when the at least one terminal position assurance member is coupled to the housing, the at least one terminal position assurance member is positioned at a supporting position at which the at least one terminal position assurance member inhibits elastic deformation of the portion of the first frontal opening.

2. The connector assembly of claim 1 wherein the at least one terminal retainer is movable into the housing in a direction transverse to the mating axis.

3. The connector assembly of claim 1 wherein the at least one terminal retainer defines the primary retaining lock with a cantilevered arm forming the portion of the first frontal opening being elastically deformable, the cantilevered arm including a first ramp elevating in the mating direction.

4. The connector assembly of claim 3 wherein the first ramp terminates in a first wall extending substantially perpendicular to the mating axis.

5. The connector assembly of claim 4 wherein the first wall extends less than fully across a width of the at least one compartment.

6. The connector assembly of claim 5 wherein the first wall extends less than halfway across the width of the at least one compartment.

7. The connector assembly of claim 1 wherein the at least one terminal retainer and the housing cooperate to define a plurality of compartments.

8. The connector assembly of claim 7 wherein the plurality of compartments are arranged in two orthogonal directions relative to the mating axis.

9. The connector assembly of claim 8 wherein the at least one terminal retainer defines respective primary retaining locks in each of the plurality of compartments with respective cantilevered arms forming the respective portion of each of the first frontal openings being elastically deformable.

10. A connector assembly for retaining at least one electrical contact assembly, comprising:

a housing extending along a mating axis;

a terminal retainer being removably coupled with the housing and operable to define a primary retaining lock for the at least one electrical contact assembly, wherein the terminal retainer cooperates with the housing to form at least one compartment formed within the housing for receiving at least a portion of the at least one electrical contact assembly, the at least one compartment extending along the mating axis and having a first frontal opening and a rear opening spaced from the first frontal opening along the mating axis, the first frontal opening positioned in a mating direction along the mating axis from the rear opening and the rear opening positioned in a disengaging direction along the mating axis from the first frontal opening, wherein at least a portion of the first frontal opening is elastically deformable such that a size of the first frontal opening is variable; and a terminal position assurance member being removably coupled to the housing and operable to define a secondary retaining lock for the at least one electrical contact assembly, wherein the terminal retainer further comprises at least one plate extending orthogonally relative to the mating axis between a leading edge and a trailing edge, at least one slot formed in the at least one plate between the leading edge and the trailing edge, and at least one cantilevered arm projecting into the at least one slot in the mating direction from the at least one plate.

11. The connector assembly of claim 10 wherein the at least one slot is further defined as a plurality of slots and the at least one cantilevered arm is further defined as a plurality of cantilevered arms.

12. The connector assembly of claim 10 wherein the at least one plate further comprises a first plate and a second plate interconnected and spaced from one another by at least one side wall.

13. The connector assembly of claim 12 wherein the at least one slot further comprises a first plurality of slots formed in the first plate and a second plurality of slots formed in the second plate and wherein the at least one cantilevered arm further comprises a first plurality of cantilevered arms each individually projecting in one of the first plurality of slots and a second plurality of cantilevered arms each individually projecting in one of the second plurality of slots.

14. The connector assembly of claim 13 wherein the first plurality of cantilevered arms and the second plurality of cantilevered arms are arranged in mirrored relation to one another.

15. The connector assembly of claim 10 wherein the leading edge is insertable into the housing and is tapered.

16. The connector assembly of claim 10 wherein the terminal retainer engages the housing in a snap-fit connection accessible from an exterior of the housing.

17. The connector assembly of claim 10 wherein the at least one terminal retainer defines a pocket, wherein at least a portion of the at least one terminal position assurance member is received in the pocket and thereby encircled by the at least one terminal retainer.

18. A connector assembly for retaining at least one electrical contact assembly, comprising:

a housing extending along a mating axis;

a terminal retainer being removably coupled with the housing and operable to define a primary retaining lock for the at least one electrical contact assembly, wherein the terminal retainer cooperates with the housing to form at least one compartment formed within the housing for receiving at least a portion of the at least one electrical contact assembly, the at least one compartment extending along the mating axis and having a first frontal opening and a rear opening spaced from the first frontal opening along the mating axis, the first frontal opening positioned in a mating direction along the mating axis from the rear opening and the rear opening positioned in a disengaging direction along the mating axis from the first frontal opening, wherein at least a portion of the first frontal opening is elastically deformable such that a size of the first frontal opening is variable; and a terminal position assurance member being removably coupled to the housing and operable to define a secondary retaining lock for the at least one electrical contact assembly, wherein the terminal retainer is moveable into the housing in a direction transverse to the mating axis and the terminal position assurance member is moveable into the housing along the mating axis.

19. The connector assembly of claim 18 wherein the terminal retainer is moveable into the housing in a direction orthogonal to the mating axis and the terminal position assurance member is moveable into the housing in the disengaging direction.

20. The connector assembly of claim 18 wherein the terminal retainer engages the housing in a first snap-fit connection accessible from an exterior of the housing and the terminal position assurance member engages the housing in a second snap-fit connection accessible from the exterior of the housing.

* * * * *